United States Patent [19]

Linares et al.

[11] Patent Number: 5,061,393

[45] Date of Patent: Oct. 29, 1991

[54] ACIDIC LIQUID DETERGENT COMPOSITIONS FOR BATHROOMS

[75] Inventors: Carlos G. Linares; William A. Cilley, both of Cincinnati, Ohio

[73] Assignee: The Procter & Gamble Company, Cincinnati, Ohio

[21] Appl. No.: 581,855

[22] Filed: Sep. 13, 1990

[51] Int. Cl.[5] ..... C11D 1/92; C11D 1/94; C11D 3/43; C11D 7/50

[52] U.S. Cl. ..... 252/143; 252/545; 252/153; 252/170; 252/173; 252/DIG. 14; 252/DIG. 11; 134/40

[58] Field of Search ..... 252/545, 143, 153, 170, 252/173, DIG. 14, DIG. 11; 134/40

[56] References Cited

U.S. PATENT DOCUMENTS

| | | | |
|---|---|---|---|
| 3,909,437 | 9/1975 | Alexander et al. | 252/143 |
| 4,000,092 | 12/1976 | Wentler | 252/526 |
| 4,013,579 | 3/1977 | Nakasone et al. | 252/143 |
| 4,111,854 | 9/1978 | Spadini et al. | 252/541 |
| 4,247,408 | 1/1981 | Imamura et al. | 252/143 |
| 4,312,855 | 1/1982 | Grand | 424/59 |
| 4,414,128 | 11/1983 | Goffinet | 252/111 |
| 4,612,135 | 9/1986 | Wenzel | 252/106 |
| 4,702,857 | 10/1987 | Gosselink | 252/174.21 |
| 4,743,395 | 5/1988 | Leifheit | 252/106 |
| 4,749,509 | 6/1988 | Kacher | 252/139 |
| 4,759,867 | 7/1988 | Choy et al. | 252/143 |
| 4,759,867 | 7/1988 | Choy et al. | 252/143 |
| 4,769,172 | 9/1988 | Siklosi | 252/153 |
| 4,804,491 | 2/1989 | Choy et al. | 252/94 |
| 4,822,854 | 4/1989 | Ciolino | 252/174.19 |
| 4,867,898 | 9/1989 | Spaulding et al. | 252/106 |
| 4,895,669 | 1/1990 | Choy et al. | 252/95 |
| 7,587,477 | 9/1990 | Culshaw et al. | |

FOREIGN PATENT DOCUMENTS

| | | |
|---|---|---|
| 52-077111 | 6/1977 | Japan . |
| 55-147600 | 11/1980 | Japan . |
| 57-000198 | 1/1982 | Japan . |
| 57-028199 | 2/1982 | Japan . |
| 57-061096 | 4/1982 | Japan . |
| 60-051792 | 3/1985 | Japan . |
| 61-012798 | 1/1986 | Japan . |
| 62-235399 | 10/1987 | Japan . |
| 2022126 | 12/1979 | United Kingdom . |

*Primary Examiner*—Paul Lieberman
*Assistant Examiner*—Erin M. Higgins
*Attorney, Agent, or Firm*—Robert B. Aylor; Richard C. Witte

[57] ABSTRACT

Detergent compositions comprising a mixture of nonionic and zwitterionic detergent surfactants; hydrophobic cleaning solvent; and polycarboxylate detergent builder provide superior cleaning of all of the soils commonly found in the bathroom. The compositions have a pH of from about 1 to about 5.5. The compositions are in the form of aqueous liquids.

22 Claims, No Drawings

ACIDIC LIQUID DETERGENT COMPOSITIONS FOR BATHROOMS

FIELD OF THE INVENTION

This invention pertains to acidic liquid detergent compositions for bathrooms. Such compositions typically contain detergent surfactants, detergent builders, and/or solvents to accomplish their cleaning tasks.

BACKGROUND OF THE INVENTION

The use of acidic cleaning compositions containing organic water-soluble synthetic detergents, solvents, and/or detergent builders for bathroom cleaning tasks are known. However, such compositions are not usually capable of providing superior hard surface cleaning for all of the soils encountered in a bathroom.

The object of the present invention is to provide detergent compositions which provide good cleaning for all of the usual hard surface cleaning tasks found in the bathroom including the removal of hard-to-remove soap scum and hard water deposits.

SUMMARY OF THE INVENTION

The present invention relates to an aqueous, acidic hard surface detergent composition comprising: (a) a mixture of nonionic and zwitterionic detergent surfactants; (b) hydrophobic solvent that provides a primary cleaning function; and (c) polycarboxylate detergent builder, said composition having a pH of from about 1 to about 5.5. The compositions can also contain an optional buffering system to maintain the acidic pH and the balance typically being an aqueous solvent system and minor ingredients. The compositions can be formulated either as concentrates, or at usage concentrations and packaged in a container having means for creating a spray to make application to hard surfaces more convenient.

DETAILED DESCRIPTION OF THE INVENTION

(a) The Detergent Surfactants

In accordance with the present invention, it has been found that mixtures of nonionic and zwitterionic detergent surfactants are required to provide superior cleaning on all of the soils found in a bathroom. The varied types of soils that may be encountered includes oily/greasy soils and soap scum. The combination of the two types of detergent surfactants provides good performance for all of the common types of soil encountered in the bathroom.

Zwitterionic Detergent Surfactants

Zwitterionic detergent surfactants contain both cationic and anionic hydrophilic groups on the same molecule at a relatively wide range of pH's. The typical cationic group is a quaternary ammonium group, although other positively charged groups like sulfonium and phosphonium groups can also be used. The typical anionic hydrophilic groups are carboxylates and sulfonates, although other groups like sulfates, phosphates, etc. can be used. A generic formula for some preferred zwitterionic detergent surfactants is:

$$R—N^{(+)}(R^2)(R^3)R^4X(-)$$

(wherein R is a hydrophobic group; $R^2$ and $R^3$ are each $C_{1-4}$ alkyl, hydroxy alkyl or other substituted alkyl group which can also be joined to form ring structures with the N; $R^4$ is a moiety joining the cationic nitrogen atom to the hydrophilic group and is typically an alkylene, hydroxy alkylene, or polyalkoxy group containing from about one to about four carbon atoms; and X is the hydrophilic group which is preferably a carboxylate or sulfonate group.

Preferred hydrophobic groups R are alkyl groups containing from about 8 to about 22, preferably less than about 18, more preferably less than about 16, carbon atoms. The hydrophobic group can contain unsaturation and/or substituents and/or linking groups such as aryl groups, amido groups, ester groups, etc. In general, the simple alkyl groups are preferred for cost and stability reasons.

A specific "simple" zwitterionic detergent surfactant is 3-(N-dodecyl-N,N-dimethyl)-2-hydroxy-propane-1-sulfonate, available from the Sherex Company under the trade name "Varion HC".

Other specific zwitterionic detergent surfactants have the generic formula:

$$R—C(O)—N(R^2)—(CR^3{}_2)_n—N(R^2)_2(+)—(CR^3{}_2)_n—SO_3(-)$$

wherein each R is a hydrocarbon, e.g., an alkyl group containing from about 8 up to about 20, preferably up to about 18, more preferably up to about 16 carbon atoms, each ($R^2$) is either hydrogen or a short chain alkyl or substituted alkyl containing from one to about four carbon atoms, preferably groups selected from the group consisting of methyl, ethyl, propyl, hydroxy substituted ethyl or propyl and mixtures thereof, preferably methyl, each ($R^3$) is selected from the group consisting of hydrogen and hydroxy groups, and each n is a number from 1 to about 4, preferably from 2 to about 3; more preferably about 3, with no more than about one hydroxy group in any ($CR^3{}_2$) moiety. The R groups can be branched and/or unsaturated, and such structures can provide spotting/filming benefits, even when used as part of a mixture with straight chain alkyl R groups. The $R^2$ groups can also be connected to form ring structures. A detergent surfactant of this type is a $C_{10-14}$ fatty acylamidopropylene(hydroxypropylene)sulfobetaine that is available from the Sherex Company under the trade name "Varion CAS Sulfobetaine".

Compositions of this invention containing the above hydrocarbyl amido sulfobetaine (HASB) can contain more perfume and/or more hydrophobic perfumes than similar compositions containing conventional anionic detergent surfactants. This can be desirable in the preparation of consumer products. Perfumes useful in the compositions of this invention are disclosed in more detail hereinafter.

Other zwitterionic detergent surfactants useful herein include hydrocarbyl, e.g., fatty, amidoalkylenebetaines (hereinafter also referred to as "HAB"). These detergent surfactants have the generic formula:

$$R—C(O)—N(R^2)—(CR^3{}_2)_n—N(R^2)_2(+)—(CR^3{}_2)_n—C(O)(-)$$

wherein each R is a hydrocarbon, e.g., an alkyl group containing from about 8 up to about 20, preferably up to about 18, more preferably up to about 16 carbon atoms, each ($R^2$) is either hydrogen or a short chain alkyl or substituted alkyl containing from one to about four carbon atoms, preferably groups selected from the group consisting of methyl, ethyl, propyl, hydroxy substituted ethyl or propyl and mixtures thereof, preferably methyl, each ($R^3$) is selected from the group consisting of hydrogen and hydroxy groups, and each n is a number from 1 to about 4, preferably from 2 to about 3; more preferably about 3, with no more than about one hydroxy group in any ($CR^3_2$) moiety. The R groups can be branched and/or unsaturated, and such structures can provide spotting/filming benefits, even when used as part of a mixture with straight chain alkyl R groups.

An example of such a detergent surfactant is a $C_{10-14}$ fatty acylamidopropylenebetaine available from the Miranol Company under the trade name "Mirataine BD".

The level of zwitterionic detergent surfactant in the composition is typically from about 0.01% to about 8%, preferably from about 1% to about 6%, more preferably from about 2% to about 4%. The level in the composition is dependent on the eventual level of dilution to make the wash solution. For cleaning, the composition, when used full strength, or the wash solution containing the composition, should contain from about 0.01% to about 8%, preferably from about 1% to about 6%, more preferably from about 2% to about 4%, of the zwitterionic detergent surfactant. Concentrated products will typically contain from about 0.02% to about 16%, preferably from about 4% to about 8% of the zwitterionic detergent surfactant.

Nonionic Detergent Cosurfactant

Compositions of this invention also contain nonionic detergent surfactant ("cosurfactant") to provide cleaning and emulsifying benefits over a wide range of soils. Nonionic cosurfactants useful herein include any of the well-known nonionic detergent surfactants that have an HLB of from about 6 to about 18, preferably from about 8 to about 16, more preferably from about 10 to about 14. Typical of these are alkoxylated (especially ethoxylated) alcohols and alkyl phenols, and the like, which are well-known from the detergency art. In general, such nonionic detergent surfactants contain an alkyl group in the $C_{8-22}$, preferably $C_{10-18}$, more preferably $C_{10-16}$, range and generally contain from about 2.5 to about 12, preferably from about 4 to about 10, more preferably from about 5 to about 8, ethylene oxide groups, to give an HLB of from about 8 to about 16, preferably from about 10 to about 14. Ethoxylated alcohols are especially preferred in the compositions of the present type.

Specific examples of nonionic detergent surfactants useful herein include decyl polyethoxylate(2.5); coconut alkyl polyethoxylate(6.5); and decyl polyethoxylate(6).

A detailed listing of suitable nonionic surfactants, of the above types, for the detergent compositions herein can be found in U.S. Pat. No. 4,557,853, Collins, issued Dec. 10, 1985, incorporated by reference herein. Commercial sources of such surfactants can be found in McCutcheon's EMULSIFIERS AND DETERGENTS, North American Edition, 1984, McCutcheon Division, MC Publishing Company, also incorporated herein by reference.

The nonionic cosurfactant component can comprise as little as 0.01% of the compositions herein, but typically the compositions will contain from about 0.5% to about 6%, more preferably from about 1% to about 4%, of nonionic cosurfactant.

The ratio of nonionic cosurfactant to zwitterionic detergent surfactant should be from about 1:4 to about 3:1, preferably from about 1:3 to about 2:1, more preferably from about 1:2 to about 1:1.

Optional Anionic Detergent Surfactant

Typical optional anionic detergent surfactants are the alkyl- and alkylethoxylate- (polyethoxylate) sulfates, paraffin sulfonates, olefin sulfonates, alpha-sulfonates of fatty acids and of fatty acid esters, and the like, which are well known from the detergency art. In general, such detergent surfactants contain an alkyl group in the $C_9$-$C_{22}$, preferably $C_{10-18}$, more preferably $C_{12-16}$, range. The anionic detergent surfactants can be used in the form of their sodium, potassium or alkanolammonium, e.g., triethanolammonium salts. $C_{12}$-$C_{18}$ paraffin-sulfonates and alkyl sulfates are especially preferred in the compositions of the present type.

A detailed listing of suitable anionic detergent surfactants, of the above types, for the detergent compositions herein can be found in U.S. Pat. No. 4,557,853, Collins, issued Dec. 10, 1985, incorporated by reference hereinbefore. Commercial sources of such surfactants can be found in McCutcheon's EMULSIFIERS AND DETERGENTS, North American Edition, 1984, McCutcheon Division, MC Publishing Company, also incorporated hereinbefore by reference.

The optional anionic detergent cosurfactant component can comprise as little as 0.001% of the compositions herein when it is present, but typically the compositions will contain from about 0.01% to about 5%, more preferably from about 0.02% to about 2%, of anionic detergent cosurfactant, when it is present. Anionic detergent surfactants are desirably not present, or are present only in limited amounts to promote rinsing of the surfaces.

(b) The Hydrophobic Solvent

In order to obtain good cleaning, especially of lipid soils, it is necessary to use a hydrophobic solvent that has cleaning activity. The solvents employed in the hard surface cleaning compositions herein can be any of the well-known "degreasing" solvents commonly used in, for example, the dry cleaning industry, in the hard surface cleaner industry and the metalworking industry. The level of hydrophobic solvent is typically from about 1% to about 15%, preferably from about 2% to about 12%, most preferably from about 5% to about 10%.

Many of such solvents comprise hydrocarbon or halogenated hydrocarbon moieties of the alkyl or cycloalkyl type, and have a boiling point well above room temperature, i.e., above about 20° C.

The formulator of compositions of the present type will be guided in the selection of solvent partly by the need to provide good grease-cutting properties, and partly by aesthetic considerations. For example, kerosene hydrocarbons function quite well for grease cutting in the present compositions, but can be malodorous. Kerosene must be exceptionally clean before it can be used, even in commercial situations. For home use, where malodors would not be tolerated, the formulator would be more likely to select solvents which have a relatively pleasant odor, or odors which can be reasonably modified by perfuming.

The $C_6$-$C_9$ alkyl aromatic solvents, especially the C6-C9 alkyl benzenes, preferably octyl benzene, exhibit excellent grease removal properties and have a low, pleasant odor. Likewise, the olefin solvents having a boiling point of at least about 100° C., especially alpha-olefins, preferably 1-decene or 1-dodecene, are excellent grease removal solvents.

Generically, the glycol ethers useful herein have the formula $R^1$ O-$R^2$O-$m^H$ wherein each $R^1$ is an alkyl group which contains from about 4 to about 8 carbon atoms, each $R^2$ is either ethylene or propylene, and m is a number from 1 to about 3, and the compound has a solubility in water of less than about 20%, preferably less than about 10%, and more preferably less than about 6%. The most preferred glycol ethers are selected from the group consisting of dipropyleneglycolmonobutyl ether, monopropyleneglycolmonobutyl ether, diethyleneglycolmonohexyl ether, monoethyleneglycolmonohexyl ether, and mixtures thereof.

The butoxy-propanol solvent should have no more than about 20%, preferably no more than about 10%, more preferably no more than about 7%, of the secondary isomer in which the butoxy group is attached to the secondary atom of the propanol for improved odor.

A particularly preferred type of solvent for these hard surface cleaner compositions comprises diols having from 6 to about 16 carbon atoms in their molecular structure. Preferred diol solvents have a solubility in water of from about 0.1 to about 20 g/100 g of water at 20° C.

Some examples of suitable diol solvents and their solubilities in water are shown in Table 1.

TABLE 1

Solubility of Selected Diols in 20° C. Water

| Diol | Solubility (g/100 g $H_2O$ |
|---|---|
| 1,4-Cyclohexanedimethanol | 20.0* |
| 2,5-Dimethyl-2,5-hexanediol | 14.3 |
| 2-Phenyl-1,2-propanediol | 12.0* |
| Phenyl-1,2-ethanediol | 12.0* |
| 2-Ethyl-1,3-hexanediol | 4.2 |
| 2,2,4-Trimethyl-1,3-pentanediol | 1.9 |
| 1,2-Octanediol | 1.0* |

*Determined via laboratory measurements. All other values are from published literature.

The diol solvents are especially preferred because, in addition to good grease cutting ability, they impart to the compositions an enhanced ability to remove calcium soap soils from surfaces such as bathtub and shower stall walls. These soils are particularly difficult to remove, especially for compositions which do not contain an abrasive. The diols containing 8–12 carbon atoms are preferred. The most preferred diol solvent is 2,2,4-trimethyl-1,3-pentanediol.

Other solvents such as benzyl alcohol, n-hexanol, and phthalic acid esters of $C_{1-4}$ alcohols can also be used.

Terpene solvents and pine oil, are usable, but are preferably not present.

(c) The Polycarboxylate Detergent Builder

Polycarboxylate detergent builders useful herein, include the builders disclosed in U.S. Pat. No. 4,915,854, Mao et al., issued Apr. 10, 1990, said patent being incorporated herein by reference. Suitable detergent builders preferably have relatively strong binding constants for calcium under acid conditions. Preferred detergent builders include citric acid, and, especially, builders having the generic formula:

$$R^5\text{—[}\text{-CH(COOH)CH(COOH)]}_nR_5$$

wherein each $R^5$ is selected from the group consisting of H and OH and n is a number from about 2 to about 3 on the average. Other preferred detergent builders include those described in the copending U.S. Pat. application Ser. No. 285,337 of Stephen Culshaw and Eddy Vos for "Hard-Surface Cleaning Compositions," filed Dec. 14, 1988, said patent application being incorporated herein by reference.

In addition to the above detergent builders, other detergent builders that are relatively efficient for hard surface cleaners and/or, preferably, have relatively reduced filming/streaking characteristics include the acid forms of those disclosed in U.S. Pat. No. 4,769,172, Siklosi, issued Sept. 6, 1988, and incorporated herein by reference. Still others include the chelating agents having the formula:

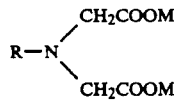

wherein R is selected from the group consisting of: $—CH_2CH_2CH_2OH$; $—CH_2CH(OH)CH_3$; $—CH_2CH(OH)CH_2OH$; $—CH(CH_2OH)_2$; $—CH_3$; $—CH_2CH_2OCH_3$;

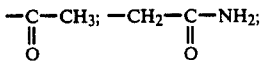

$—CH_2CH_2CH_2OCH_3$; $—C(CH_2OH)_3$; and mixtures thereof; and each M is hydrogen.

Chemical names of the acid form of the chelating agents herein include:

N(3-hydroxypropyl)imino-N,N-diacetic acid (3-HPIDA);

N(-2-hydroxypropyl)imino-N,N-diacetic acid (2-HPIDA);

N-glycerylimino-N,N-diacetic acid (GLIDA);

dihydroxyisopropylimino-(N,N)-diacetic acid (DHPIDA);

methylimino-(N,N)-diacetic acid (MIDA);

2-methoxyethylimino-(N,N)-diacetic acid (MEIDA);

amidoiminodiacetic acid (also known as sodium amidonitrilo triacetic, SAND);

acetamidoiminodiacetic acid (AIDA);

3-methoxypropylimino-N,N-diacetic acid (MEPIDA); and tris(hydroxymethyl)methylimino-N,N-diacetic acid (TRIDA).

Methods of preparation of the iminodiacetic derivatives herein are disclosed in the following publications:

Japanese Laid Open publication 59-70652, for 3-HPIDA;

DE-OS-25 42 708, for 2-HPIDA and DHPIDA;

Chem. ZVESTI 34(1) p. 93–103 (1980), Mayer, Riecanska et al., publication of Mar. 26, 1979, for GLIDA;

C.A. 104(6)45062 d for MIDA; and

Biochemistry 5, p. 467 (1966) for AIDA.

The chelating agents of the invention are present at levels of from about 2% to about 14% of the total composition, preferably about 3% to about 12%., more preferably from about 5% to about 10%.

The acidic detergent builders herein will normally provide the desired pH in use. However, if necessary, the composition can also contain additional buffering materials to give a pH in use of from about 1 to about 5.5, preferably from about 2 to about 4.5, more preferably from about 3 to about 4.5. pH is usually measured on the product. The buffer is selected from the group consisting of: mineral acids such as HCl, $HNO_3$, etc. and organic acids such as acetic, succinic, tartaric, etc., and mixtures thereof. The buffering material in the system is important for spotting/filming. Preferably, the compositions are substantially, or completely free of materials like oxalic acid that are typically used to provide cleaning, but which are not desirable from a safety standpoint in compositions that are to be used in the home, especially when very young children are present.

The Aqueous Solvent System

The balance of the formula is typically water. Nonaqueous polar solvents with only minimal cleaning action like methanol, ethanol, isopropanol, ethylene glycol, propylene glycol, and mixtures thereof are usually not present. When the nonaqueous solvent is present, the level of nonaqueous polar solvent is from about 0.5% to about 10%, preferably less than about 5% and the level of water is from about 50% to about 97%, preferably from about 75% to about 95%.

Optional Ingredients

The compositions herein can also contain other various adjuncts which are known to the art for detergent compositions so long as they are not used at levels that cause unacceptable spotting/filming. Nonlimiting examples of such adjuncts are:

Enzymes such as proteases;

Hydrotropes such as sodium toluene sulfonate, sodium cumene sulfonate and potassium xylene sulfonate; and Aesthetic-enhancing ingredients such as colorants and perfumes, providing they do not adversely impact on spotting/filming in the cleaning of glass. The perfumes are preferably those that are more water-soluble and/or volatile to minimize spotting and filming.

Perfumes

Most hard surface cleaner products contain some perfume to provide an olfactory aesthetic benefit and to cover any "chemical" odor that the product may have. The main function of a small fraction of the highly volatile, low boiling (having low boiling points), perfume components in these perfumes is to improve the fragrance odor of the product itself, rather than impacting on the subsequent odor of the surface being cleaned. However, some of the less volatile, high boiling perfume ingredients can provide a fresh and clean impression to the surfaces, and it is sometimes desirable that these ingredients be deposited and present on the dry surface. Perfume ingredients are readily solubilized in the compositions by the nonionic and zwitterionic detergent surfactants. Anionic detergent surfactants will not solubilize as much perfume, especially substantive perfume, or maintain uniformity to the same low temperature.

The perfume ingredients and compositions of this invention are the conventional ones known in the art. Selection of any perfume component, or amount of perfume, is based solely on aesthetic considerations. Suitable perfume compounds and compositions can be found in the art including U.S. Pat. Nos.: 4,145,184, Brain and Cummins, issued Mar. 20, 1979; 4,209,417, Whyte, issued June 24, 1980; 4,515,705, Moeddel, issued May 7, 1985; and 4,152,272, Young, issued May 1, 1979, all of said patents being incorporated herein by reference.

In general, the degree of substantivity of a perfume is roughly proportional to the percentages of substantive perfume material used. Relatively substantive perfumes contain at least about 1%, preferably at least about 10%, substantive perfume materials.

Substantive perfume materials are those odorous compounds that deposit on surfaces via the cleaning process and are detectable by people with normal olfactory acuity. Such materials typically have vapor pressures lower than that of the average perfume material. Also, they typically have molecular weights of about 200 or above, and are detectable at levels below those of the average perfume material.

Perfume ingredients useful herein, along with their odor character, and their physical and chemical properties, such as boiling point and molecular weight, are given in "Perfume and Flavor Chemicals (Aroma Chemicals)," Steffen Arctander, published by the author, 1969, incorporated herein by reference.

Examples of the highly volatile, low boiling, perfume ingredients are: anethole, benzaldehyde, benzyl acetate, benzyl alcohol, benzyl formate, iso-bornyl acetate, camphene, cis-citral (neral), citronellal, citronellol, citronellyl acetate, paracymene, decanal, dihydrolinalool, dihydromyrcenol, dimethyl phenyl carbinol, eucalyptol, geranial, geraniol, geranyl acetate, geranyl nitrile, cis-3-hexenyl acetate, hydroxycitronellal, d-limonene, linalool, linalool oxide, linalyl acetate, linalyl propionate, methyl anthranilate, alpha-methyl ionone, methyl nonyl acetaldehyde, methyl phenyl carbinyl acetate, laevo-menthyl acetate, menthone, iso-menthone, myrcene, myrcenyl acetate, myrcenol, nerol, neryl acetate, nonyl acetate, phenyl ethyl alcohol, alphapinene, beta-pinene, gamma-terpinene, alpha-terpineol, beta-terpineol, terpinyl acetate, and vertenex (para-tertiary-butyl cyclohexyl acetate). Some natural oils also contain large percentages of highly volatile perfume ingredients. For example, lavandin contains as major components: linalool; linalyl acetate; geraniol; and citronellol. Lemon oil and orange terpenes both contain about 95% of d-limonene.

Examples of moderately volatile perfume ingredients are: amyl cinnamic aldehyde, iso-amyl salicylate, beta-caryophyllene, cedrene, cinnamic alcohol, coumarin, dimethyl benzyl carbinyl acetate, ethyl vanillin, eugenol, iso-eugenol, flor acetate, heliotropine, 3-cis-hexenyl salicylate, hexyl salicylate, lilial (para-tertiarybutyl-alpha-methyl hydrocinnamic aldehyde), gammamethyl ionone, nerolidol, patchouli alcohol, phenyl hexanol, betaselinene, trichloromethyl phenyl carbinyl acetate, triethyl citrate, vanillin, and veratraldehyde. Cedarwood terpenes are composed mainly of alpha-cedrene, beta-cedrene, and other $C_{15}H_{24}$ sesquiterpenes.

Examples of the less volatile, high boiling, perfume ingredients are: benzophenone, benzyl salicylate, ethylene brassylate, galaxolide (1,3,4,6,7,8-hexahydro-4,6,6,7,8,8-hexamethyl-cyclopenta-gama-2-benzopyran), hexyl cinnamic aldehyde, lyral (4-(4-hydroxy-4-methyl pentyl)-3-cyclohexene-10-carboxaldehyde), methyl cedrylone, methyl dihydro jasmonate, methyl-beta-naphthyl ketone, musk indanone, musk ketone, musk tibetene, and phenylethyl phenyl acetate.

Selection of any particular perfume ingredient is primarily dictated by aesthetic considerations, but more water-soluble materials are preferred, as stated hereinbefore, since such materials are less likely to adversely affect the good spotting/filming properties of the compositions.

These compositions have exceptionally good cleaning properties. They also have good "shine" properties, i.e., when used to clean glossy surfaces, without rinsing, they have much less tendency than e.g., phosphate built products to leave a dull finish on the surface.

In a preferred process for using the products described herein, and especially those formulated to be used at full strength, the product is sprayed onto the surface to be cleaned and then wiped off with a suitable material like cloth, a paper towel, etc. It is therefore highly desirable to package the product in a package that comprises a means for creating a spray, e.g., a pump, aerosol propellant and spray valve, etc.

All parts, percentages, and ratios herein are "by weight" unless otherwise stated.

The invention is illustrated by the following Examples.

| Ingredient | Weight % |
|---|---|
| 3-(N-dodecyl-N,N-dimethyl)-2-hydroxy-propane-1-sulfonate (DDHPS) | 2.0 |
| Decyl polyethoxylate (2.5) (DPE2.5) | 1.1 |
| Decyl polyethoxylate (6.0) (DPE6) | 2.9 |
| Butoxy Propoxy Propanol (BPP) | 5.0 |
| Oxydisuccinic Acid (ODS) | 10.0 |
| Sodium Cumene Sulfonate (SCS) | 4.2 |
| Water, Buffering Agents, and Minors | up to 100 |

pH = 3.0

EXAMPLE II

| Ingredient | Weight % |
|---|---|
| DDHPS | 2.0 |
| DPE6 | 2.0 |
| BPP | 8.0 |
| Citric Acid | 10.0 |
| SCS | 1.6 |
| Water, Buffering Agents, and Minors | up to 100 |

pH = 3.0

EXAMPLE III

| Ingredient | Weight % |
|---|---|
| DDHPS | 2.0 |
| DPE6 | 2.0 |
| BPP | 6.0 |
| ODS | 10.0 |
| SCS | 5.2 |
| Water, buffering Agents, and Minors | up to 100 |

pH = 3.0

EXAMPLE IV

A liquid hard surface cleaner composition is prepared according to the following formula:

| Ingredient | Weight % |
|---|---|
| DDHPS | 2.0 |
| ODS | 10.0 |
| DPE6 | 2.0 |
| BPP | 6.0 |
| SCS | 7.5 |

-continued

| Ingredient | Weight % |
|---|---|
| Water, Buffering Agents, and Minors | up to 100 |

pH = 4.5

EXAMPLE V

A composition is prepared according to the following formula:

| Ingredient | Weight % |
|---|---|
| DDHPS | 2.0 |
| DPE6 | 2.0 |
| Citric acid | 10.0 |
| BPP | 6.0 |
| SCS | 8.9 |
| Water, Buffering Agent, and Minors | up to 100 |

pH = 4.5

EXAMPLE VI

Hard surface cleaning compositions are prepared according to the following formulae:

Composition A

| Ingredient | Weight % |
|---|---|
| DDHPS | 6.0 |
| DPE6 | 0.0 |
| Citric Acid | 10.0 |
| BPP | 5.0 |
| Water, Buffering Agent, and Minors | up to 100 |

pH = 3.0

Composition B

| Ingredient | Weight % |
|---|---|
| DDHPS | 0.0 |
| DPE6 | 6.0 |
| Citric Acid | 10.0 |
| BPP | 5.0 |
| Water, Buffering Agent, and Minors | up to 100 |

pH = 3.0

Composition C

Composition C

| Ingredient | Weight % |
|---|---|
| DDHPS | 4.0 |
| DPE6 | 2.0 |
| Citric Acid | 10.0 |
| BPP | 5.0 |
| Water, Buffering Agent, and Minors | up to 100 |

pH = 3.0

When Compositions A, B, and C are tested on a soil that is representative of a shower wall, that contains a large amount of calcium soap, the percentage removal for A and B is 71% and the percentage removal for C is 85%. The combination of nonionic and zwitterionic detergent surfactants is clearly superior to the individual surfactants. The removal is comparable to that provided by a commercial product having a pH of about 1 that is more likely to cause damage to the surface being treated.

When the BPP solvent is replaced by a less hydrophobic solvent, the removal of more oily soils is much less. For example, when the BPP is replaced by the more common butyl cellosolve, the removal of a typical oily soil found in the bathroom is reduced by about one fourth. The combination of the nonionic and zwitterionic detergent surfactants; the detergent builder that is effective at low pH; and the hydrophobic solvent provides a hard surface cleaner that is effective on the typical soap scum encountered in the bathroom and also on other more oily soils that can be encountered in the bathroom.

EXAMPLE VII

| Ingredient | Weight % |
|---|---|
| 3-(N-cetyl-N,N-dimethyl)-propane-1-sulfonate | 2.0 |
| DPE2.5 | 1.1 |
| DPE6 | 2.9 |
| ODS | 10.0 |
| BPP | 5.0 |
| Water, Buffering Agents, and Minors | up to 100 |

pH = 2.5

This composition provides satisfactory removal of the shower wall soil of Example VI.

What is claimed is:

1. An acidic aqueous hard surface detergent composition comprising: (a) mixture of from about 0.01% to about 8% of zwitterionic detergent surfactant and from about 0.1% to about 6% of nonionic detergent surfactant; (b) from about 1% to about 15% of hydrophobic solvent that provides a cleaning function; (c) from about 2% to about 14% of polycarboxylate detergent builder; and (d) the balance being an aqueous solvent system and minor ingredients, the pH of said composition being from about 1 to about 5.5.

2. The composition of claim 1 wherein said zwitterionic detergent surfactants has the formula:

$$R—N^{(+)}(R^2)(R^3)R^4X(-)$$

wherein R is a hydrophobic group; $R^2$ and $R^3$ are each $C^{1-4}$ alkyl, hydroxy alkyl or other substituted alkyl group which can also be joined to form ring structures with the N; $R^4$ is a moiety joining the cationic nitrogen atom to the hydrophilic group and is an alkylene, hydroxy alkylene, or polyalkoxy group containing from about 1 to about 4 carbon atoms; and X is the hydrophilic group which is a carboxylate or sulfonate group.

3. The composition of claim 2 containing sufficient buffering material to maintain a pH of from about 2 to about 4.5.

4. The composition of claim 2 wherein said nonionic detergent surfactant has an HLB of from about 10 to about 14.

5. The composition of claim 4 containing sufficient buffering material to maintain a pH of from about 2 to about 4.5.

6. The composition of claim 1 containing from about 1% to about 15% of said organic solvent (b), said solvent having a solubility in water of less than about 20%.

7. The composition of claim 6 wherein said solvent (b) is selected from the group consisting of alkyl and cycloalkyl hydrocarbons add halohydrocarbons, alpha olefins, benzyl alcohol, glycol ethers, and diols containing 6 to 16 carbon atoms.

8. The composition of claim 7 wherein said solvent (b) is a diol containing from about 8 to about 12 carbon atoms.

9. The composition of claim wherein said solvent (b) is 2,2,4-trimethyl-1,3-pentanediol.

10. The composition of claim 6 wherein said solvent (b) has the formula wherein each $R^1O\text{-}R^2O\text{-}m^H$ is an alkyl group which contains from about 4 to about 8 carbon atoms, each R2 is selected from the group consisting of ethylene or propylene, and m is a number from 1 to about 3.

11. The composition of claim 10 wherein said solvent (b) is selected from the group consisting of dipropyleneglycolmonobutyl ether, monopropyleneglycolmonobutyl ether, diethyleneglycolmonohexyl ether, monoethyleneglycolmonohexyl ether, and mixtures thereof.

12. The composition of claim 1 containing from about 1% to about 15% of said organic solvent (b) having the formula $R^1O\text{-}R^2O\text{-}m^H$ wherein each $R^1$ is an alkyl group which contains from about 4 to about 8 carbon atoms, each $R^2$ is selected from the group consisting of ethylene or propylene, and m is a number from 1 to about 3.

13. The composition of claim 1 containing from about 1% to about 15% of said organic solvent (b) selected from the group consisting of alkyl and cycloalkyl hydrocarbons and halohydrocarbons, alpha olefins, benzyl alcohol, glycol ethers, and diols containing 6 to 16 carbon atoms.

14. The composition of claim 1 wherein said zwitterionic detergent surfactant is a hydrocarbyl-amidoalkylenesulfobetaine having the formula:

$$R—C(O)—N(R^2)—(CR^3{}_2)_n\text{-}N(R^2)_2(+)—(CR^3{}_2\text{-})_n—S(O)_3(-)$$

wherein each R is an alkyl group containing from about 10 to about 18 carbon atoms, each ($R^2$) is selected from the group consisting of methyl, ethyl, propyl, hydroxy substituted ethyl or propyl and mixtures thereof, each ($R^3$) is selected from the group consisting of hydrogen and hydroxy groups, and each n is a number from 1 to about 4; with no more than about one hydroxy group in any ($CR^3{}_2$) moiety.

15. The composition of claim 14 wherein said nonionic detergent surfactant has an HLB of from about 10 to about 14.

16. The composition of claim 15 containing sufficient buffering material to maintain a pH of from about 2 to about 4.5.

17. The composition of claim 16 containing from about 1% to about 15% of said organic solvent (b), said solvent having a solubility in water of less than about 20%.

18. The composition of claim 14 wherein said solvent (b) is selected from the group consisting of alkyl and cycloalkyl hydrocarbons and halohydrocarbons, alpha olefins, benzyl alcohol, glycol ethers, and diols containing 6 to 16 carbon atoms.

19. The composition of claim 18 containing from about 1% to about 15% of organic solvent (b) having the formula $R^1O\text{-}R^2)\text{-}m^H$ wherein each $R^1$ is an alkyl group which contains from about 4 to about 8 carbon atoms, each $R^2$ is selected from the group consisting of ethylene or propylene, and m is a number from 1 to about 3.

20. The composition of claim 1 wherein the pH of said composition is from about 2 to about 4.5.

21. The composition of claim 20 wherein the level of said zwitterionic detergent surfactant is from about 1% to about 6%; the level of said nonionic detergent surfactant is from about 0.5% to about 6%; the ratio of said nonionic to said zwitterionic detergent surfactant is from about 1:3 to about 2:1; the level of said hydrophobic solvent is from about 2% to about 12%; the level of said polycarboxylate detergent builder is from about 3% to about 12%; and the pH of said composition is from about 2 to about 4.5.

22. The process of cleaning hard surfaces comprising spraying said surfaces with the composition of claim 1.

* * * * *